US005294138A

United States Patent [19]

Yang

[11] Patent Number: 5,294,138

[45] Date of Patent: Mar. 15, 1994

[54] TRAFFIC CONTROL CART

[76] Inventor: Nan S. Yang, No. 16, Hsin Hsing St., Wu Wang Tsun, Yung Kang Hsiang, Tainan Hsien, Taiwan

[21] Appl. No.: 42,733

[22] Filed: Apr. 5, 1993

[51] Int. Cl.[5] ..... G08G 1/095

[52] U.S. Cl. ..... 280/47.34; 340/908; 340/926; 116/63 P

[58] Field of Search ..... 280/47.17, 47.24, 47.26, 280/47.34, 79.11; 340/907, 908, 926, 473; 116/63 R, 63 P; 40/612

[56] References Cited

U.S. PATENT DOCUMENTS 2,401,940 6/1946 Lange ..... 340/908
3,729,706 4/1973 Hein ..... 340/908
4,543,905 10/1985 McKenneg ..... 116/63 P
4,616,225 10/1986 Woudenberg ..... 340/908
4,777,751 10/1988 Pasquale ..... 340/908
4,992,788 2/1991 Arndt ..... 340/908
5,252,969 10/1993 Kishi ..... 340/908

*Primary Examiner*—Richard M. Camby
*Attorney, Agent, or Firm*—Hedman, Gibson & Costigan

[57] ABSTRACT

A traffic control cart includes a rolling wheel assembly, a base fixed on the rolling wheels, a column mounted on the base, an arm pivotally secured on one periphery wall of the column, a light device including at least a green light, a yellow light, and a red light being mounted on a top face of the column. The arm is allowed to reciprocate in a ninety-degree range from vertical position to horizontal position, in the meanwhile one color of the traffic lights is "on" thus controlling the traffic therearound.

7 Claims, 11 Drawing Sheets

TRAFFIC CONTROL CART

FIELD OF THE INVENTION

The present invention relates to a traffic control cart as an auxiliary device for a traffic officer.

BACKGROUND OF THE INVENTION

The conventional traffic lights are not adequate to support the traffic controlling duty at the present time. Many schools or companies allocate several traffic officers to control the traffic conditions near the entrance thereof during the rush hour. Usually, at least one traffic officer is in control the traffic and two assistants each stand at one side of the road to waive a traffic flag. However, the traffic officer needs to concentrate very carefully to control the traffic condition. It is requisite to have a traffic control cart having traffic lights thereon to help the traffic officer to control the traffic condition. More over, the traffic control cart can handle the traffic situation as a normal traffic light does, therefore, it can release a lot of pressure from the traffic officer.

SUMMARY OF THE INVENTION

It is the purpose of the present invention to provide a traffic control cart which comprises a plurality of lights and an arm situated on a body portion of the cart. The arm is set in a horizontal position when in red light condition to block the cars and in a vertical position when in green light condition allowing the cars to pass.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
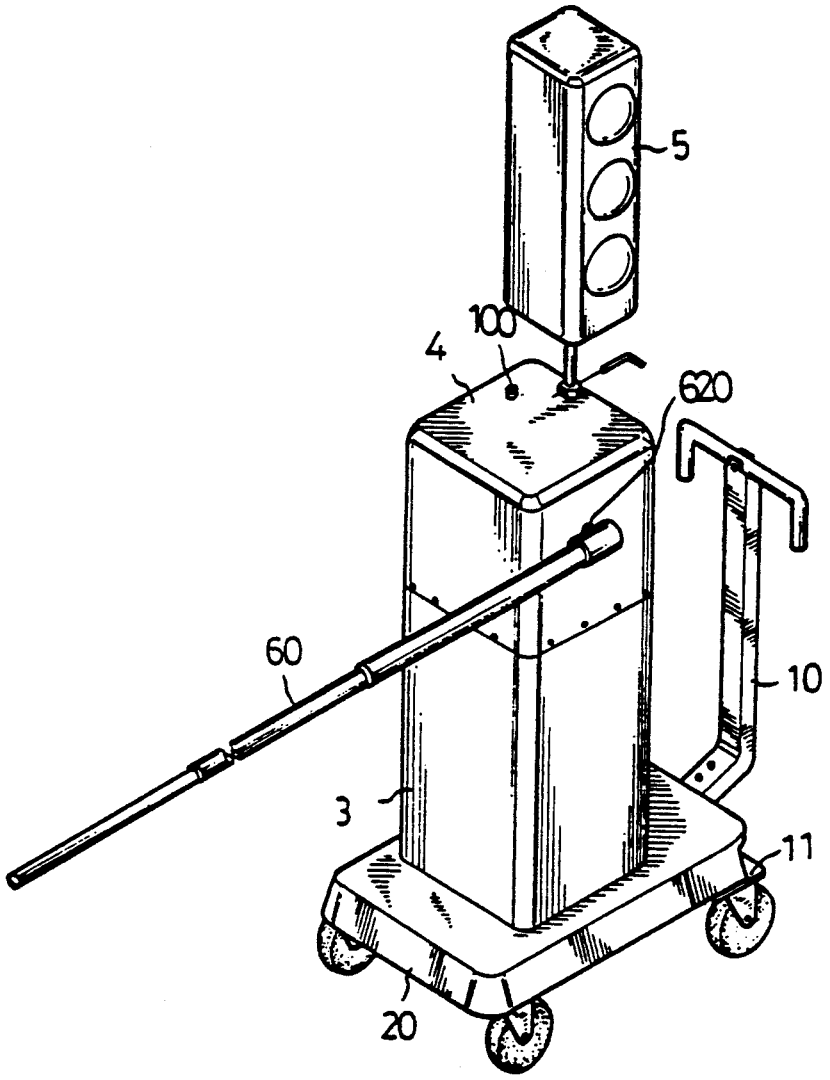
FIG. 1 is a perspective view of a traffic control cart in accordance with one embodiment of the present invention.
Figure 2:
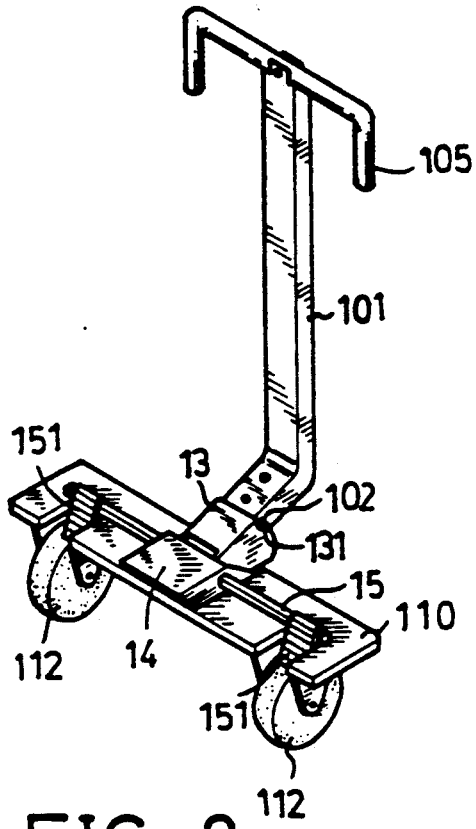
FIG. 2 is a perspective view of a handle portion of FIG. 1.

Now referring to the drawings and initially to FIGS. 1 and 2, a traffic control cart shown in a preferred embodiment in accordance with the present invention generally comprises a wheel assembly 11 including a pair of engaging members 110 parallelly spaced in an appropriate distance, each holding a pair of rolling wheels 112, 113 in two distal ends thereof, a rectangular base 20 securely mounted on the wheel assembly 11 thus fixing the two engaging members 110 in two sides thereof, a braking means 10 comprising a handle bar 101 secured to one of the engaging members 110, a first securing member 13, a second securing member 14, a transmission rod 15 being operative in concert with the handle bar 101 as will be described in detail later, and a pair of braking members 151 fixed at two distal ends of the transmission rod 15 allowed to brake or release the rolling wheels 112, 113 as will be described in detail later, a lower column 3 securely seated on the base 20, an upper column 4 pivotally secured to a top face of the lower column 3, an arm 60 pivotally attached to one face of the upper column 4, and a light means 5 secured to a top face of the upper column 4. The light means 5 comprises a green light, a yellow light, and a red light. A power switch 100 is installed at the top surface of the upper column 4 allowing the traffic officer to turn it on and provides the requisite electric power to a motor (not shown) and the lights. The handle bar 101 substantially is "L" shaped, substantially including a vertical bar and a lateral bar, and has an upper end at the vertical bar thereof and a lower end at the lateral bar thereof. Actually, the handle bar 101 is a tube structure having hollow space therein. Similarly, the first securing member 13 and the second securing member 14 are also hollow structures. The transmission rod 15 is pivotally held by the second securing member 14 with middle portion thereof remained in the second securing member 14. A handle fork 105 secured at the upper end of the handle bar 101 allows the user to operate the cart easily. A first pin 102 is securely installed in the lateral bar of the handle bar 101 and is substantially perpendicular to the longitudinal direction thereof. The first pin 102 also penetrates the periphery of the handle bar 101. The engaging member 110 which secures to the handle bar 101 is designated as the "rear" side of the wheel assembly 11, while the one opposite to the rear side is the "front" side (not shown). The rolling wheels 113 and 112 thus are designated as front wheels 113 and rear wheels 112 respectively. The first securing member 13 and the second securing member 14 are firmly mounted on the rear engaging member 110. The first securing member 13 has a recess 131 for positioning the first pin 102 of the handle bar 101. The rectangular base 20 is substantially a shell (or casing) structure which is securely mounted on the front and the rear engaging members 110, yet not affecting the operation of the transmission rod 15, the braking members 151, and the rolling wheels 112 and 113.

Figure 3:
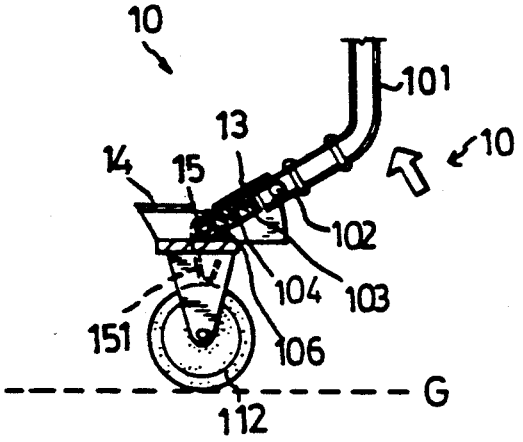
FIG. 3 is a partial side plan view partly in section of FIG. 2 illustrating the rolling wheel is in a braked status.
Figure 4:
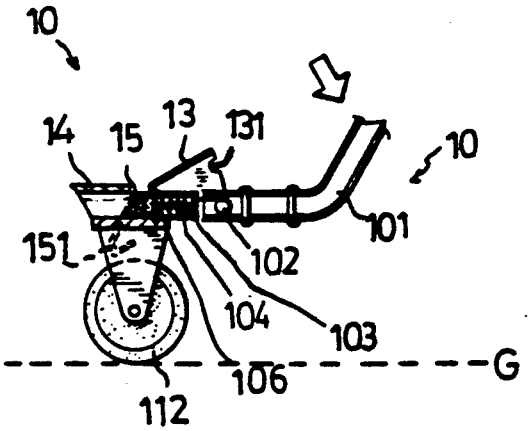
FIG. 4 is another partial side plan view partly in section of FIG. 2 illustrating the rolling wheel is not in a braked status.

Referring to FIGS. 3 and 4, the braking means 10 further comprises a transmission tube 103 which has a first end substantially connected to a middle portion of the transmission rod 15 and a second end contacting against the lower end of the handle bar 101, a second pin 106 securely installed therein substantially perpendicular to the longitudinal direction thereof. A spring 104 has two ends each respectively fixed on the first pin 102 of the handle bar 101 and the second pin 106 of the transmission tube 101 thereby enabling the lower end of the handle bar 101 to firmly contact against the second end of the transmission tube 103.

The cart is allowed to function in a braking mode, as shown in FIG. 3, for positioning the cart in a specific site (such as road intersection), or a non-braking mode, as shown in FIG. 4, for transporting the cart to a required site. Particularly referring to FIG. 3, the lateral bar of the handle bar 101 is lifted to be slanted with respect to a ground line G. When the cart is in braking mode, the first pin 102 is positioned in the recess 131 of the first securing member 13 by manually lifting up the handle bar 101, and the braking members 151 thus forces against the rear rolling wheels 112 and stops the cart. The elasticity of the spring 104 cooperates with the recess structure 131 causing the first pin 102 to remain in the recess 131. Actually merely by means of the recess 131 can not limit the first pin 102 therein, because the recess 131 is merely a relatively shallow arcuate structure not enough to support the weight of the handle bar 101 and the handle fork 105. Now referring from FIG. 3 to FIG. 4, the first pin 102 will release from the recess 131, when the user presses the handle bar 101 downward. It is understandable that a force from the user will decrease and bias the elasticity force of the spring 104, thus causing the first pin 102 to release from the recess 131. When the user operates the handle fork 105 in a downward direction causing the lateral bar of the handle bar and the transmission tube 103 from a slanted status to a horizontal status, which in turn causes the transmission rod 15 to rotate in a clockwise manner, thus causing the braking members 151 to disengage from the rolling wheels 112.

Figure 5:
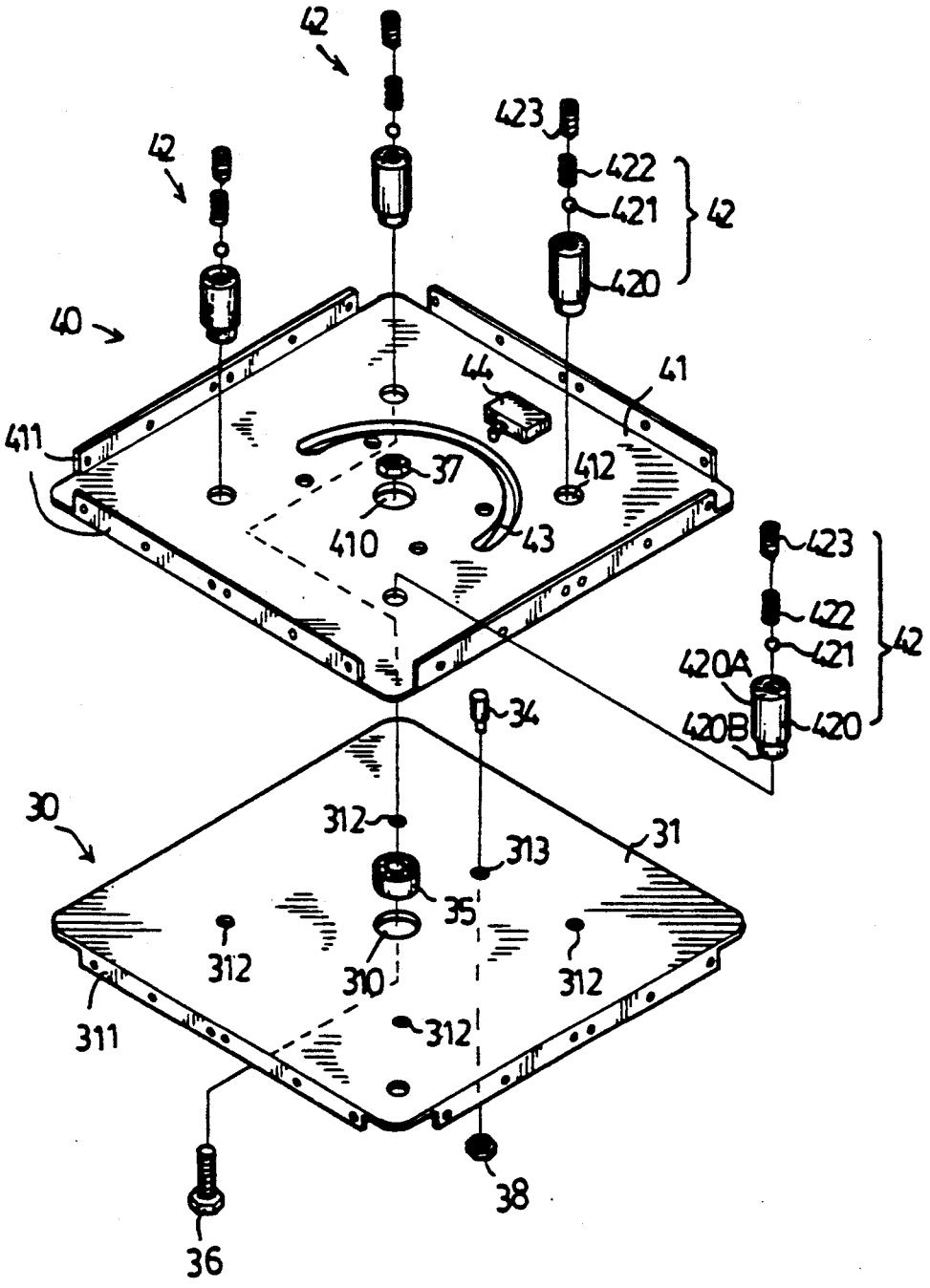
FIG. 5 is an exploded view illustrating the pivotable structure between an upper body portion and a lower body portion of FIG. 1.

Referring to FIGS. 1 and 5, a structure for the upper column 4 pivotally secured to the top face of the lower column 3 is illustrated in more detail. The upper column 4 and the lower column 3 each have an upper pivotal means 40 and a lower pivotal means 30 respectively at the bottom and the top thereof. A bearing assembly together with the upper pivotal means 40 and the lower pivotal means 30 constitutes the pivotal structure between the upper column 4 and the lower column 3. The bearing assembly comprises a bearing member 35, a bolt 36, and a nut 37.

The upper pivotal means 40 comprises a first plate 41 and four positioning means 42. The first plate 41 has a first central hole 410, four flange portions 411 at four sides bent upward therefrom for securing an upper casing body of the upper column 4, a semicircular slot 43 formed around the first central hole 410 and concentric with the central hole 410, four first corner holes 412 symmetrically distributed around the first central hole 410. A first micro-switch 44 is attached on the first plate 41 substantially near the middle portion of the semicircular slot 43. The first plate 41 together with the upper casing body constitute the outlook of the upper column 4 as shown in FIG. 1. Each positioning means 42 includes a tubular socket member 420, a ball bearing 421, a spring 422, and a bolt 423. The socket member 420 has a body portion 420A and a neck portion 420B integrally extending from one end of the body portion 420A, thereby forming a shoulder portion therebetween. A throughole (not labeled) is formed in the socket member 420 and tapers from one end of the body portion 420A to one end of the neck portion 420B. Near the end of the body portion 420A is threaded for fixing the bolt 423 therein. The dimensions of the rolling ball 421, the spring 422, the bolt 423, and the throughole are appropriately designed such that the rolling ball 421, the spring 422, and the bolt 423 are sequentially disposed in the through hole, with the spring 422 forcing against the rolling ball 421 and allowing the ball bearing 421 to have a portion protruding out of the neck portion 420B.

The lower pivotal means 30 comprises a detecting rod 34, and a second plate 31 which has similar dimensions and shape as the first plate 41. The second plate 31 has a second central hole 310 substantially corresponding to the first central hole 410 of the first plate 41, four flange portions 311 at four sides bent downward therefrom for securing to a lower casing body of the lower column 3, a positioning hole 313 formed thereon substantially corresponding to a middle position of the semicircular slot 43 of the first plate 41, and four second corner holes 312 symmetrically distributed around the second central hole 310, each corresponding to one of the first corner holes 412. The second plate 31 securing to the lower casing body constitutes the outlook of the lower column 3 as shown in FIG. 1. When the upper pivotal means 40 and the lower pivotal means 30 are assembled, the central holes 410 and 310 are in alignment with each other, each corresponding first corner hole 412 and second corner hole 312 being in alignment with each other, the bearing member 35 being interconnected between the first plate 41 and the second plate 31 by securing the bolt 36 at a lower surface of the second plate 31 through the central holes 310, 410 and to the nut 37 positioned at an upper periphery of the first central hole 410 of the first plate 41. Each positioning means 42 is firmly fixed at the top surface of the first plate 41 by inserting the neck portion 420B into a corresponding first corner hole 412 with the shoulder thereof having glue or the like attached to stick on the periphery of the first corner hole 412. As mentioned, a portion of the ball bearing 421 will protrude out of the neck portion 420*b*. The protruding portion of the rolling ball 421 is received by the corresponding second corner hole 312, thereby positioning the first plate 41 on the second plate 31. The detecting rod 34 is fixed on the positioning hole 313 of the second plate 31 by means of a nut 38, and penetrates through the middle portion of the semicircular slot 43.

Figure 6:
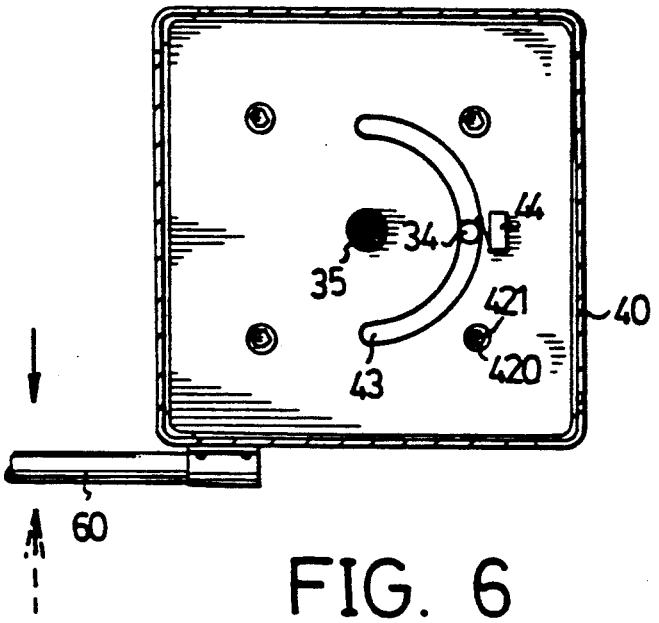
FIG. 6 is a schematic view illustrating the pivotable rotation between the upper body portion and the lower body portion when the traffic control cart is in a normal status.
Figure 7:
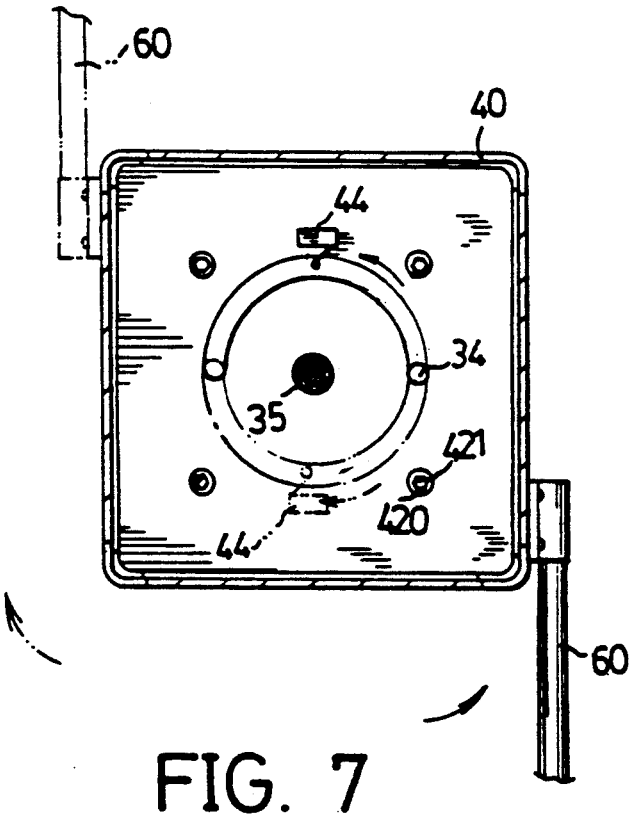
FIG. 7 is a schematic view illustrating the pivotable rotation between the upper body portion and the lower body portion when the traffic control cart is in a normal status.

FIG. 6 illustrates a normally spatial relation between the detecting rod 34 and the first micro-switch 44. Normally, the detecting rod 34 contacts with the micro-switch 44 and the cart is in normal operative condition. However, if the arm 60 of FIG. 6 is hit by a car or the like from the top (or bottom) direction of the figure, the spatial relation between the detecting rod 34 and the semicircular slot 43 will change from FIG. 6 to FIG. 7, where the solid line indicates the impact from the top direction, while the dotted line indicates the impact from the bottom direction. Actually the micro-switch 44 is connected to a buzzer (not shown) and a flashing light (not shown), thus when the arm 60 is hit by an external force causing the detecting rod 34 to discontact with the microswitch 44, the buzzer will emit alarming sound and the flashing light will flash and indicate the traffic officer to manually rotate the arm 60 back to normal position as shown in FIG. 6.

Figure 8:
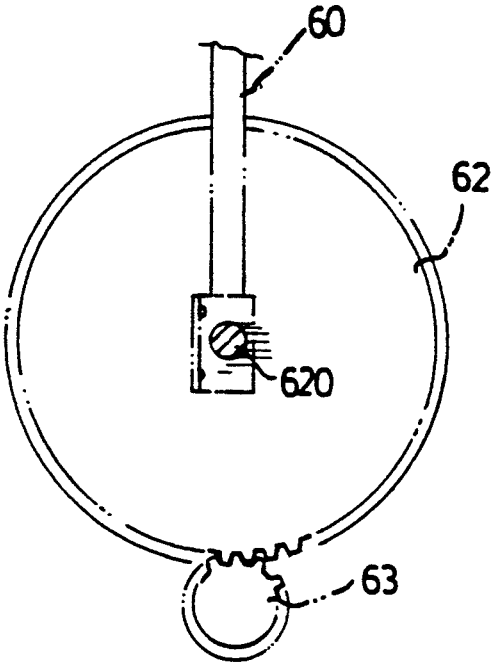
FIG. 8 is a schematic view illustrating an arm in FIG. 1 is driven to control the front side of the road when in green light condition.
Figure 9:
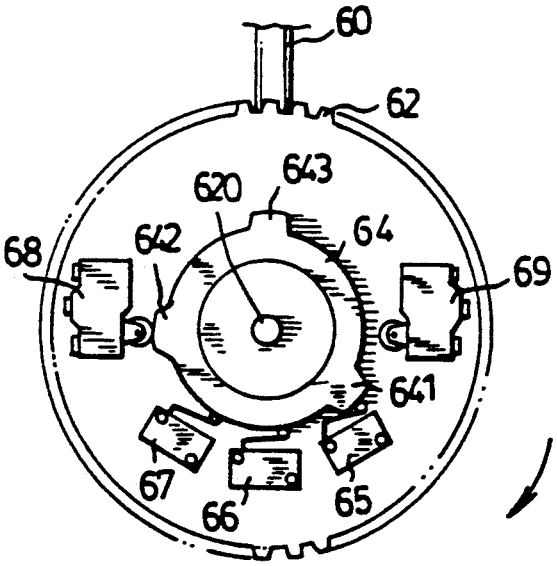
FIG. 9 is a schematic view illustrating the arm of FIG. 8 driven to control the traffic office side of the road when in green light condition.
Figure 10:
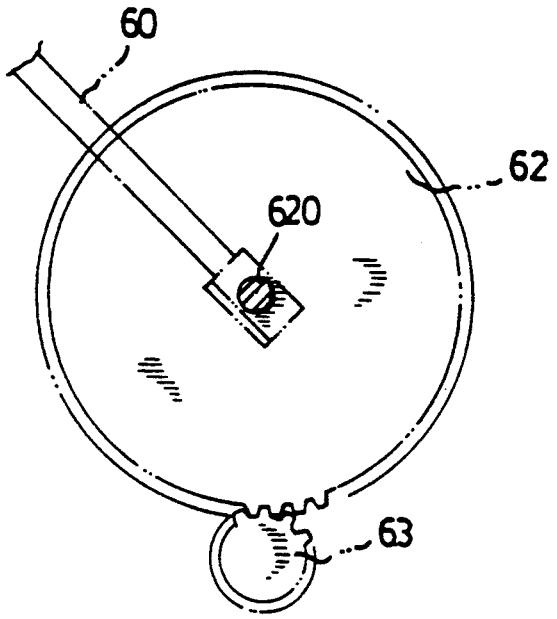
FIG. 10 is a schematic view illustrating the arm of FIG. 8 driven to control the traffic of the front side of the road when in yellow light condition.
Figure 11:
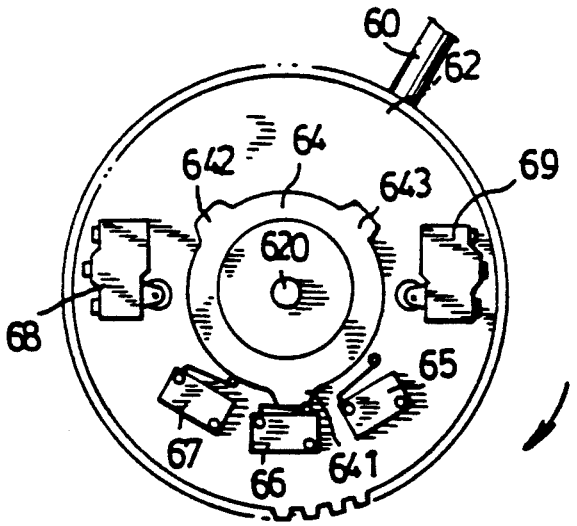
FIG. 11 is a schematic view illustrating the arm of FIG. 8 driven to control the traffic of the rear side of the road when in yellow light condition.
Figure 12:
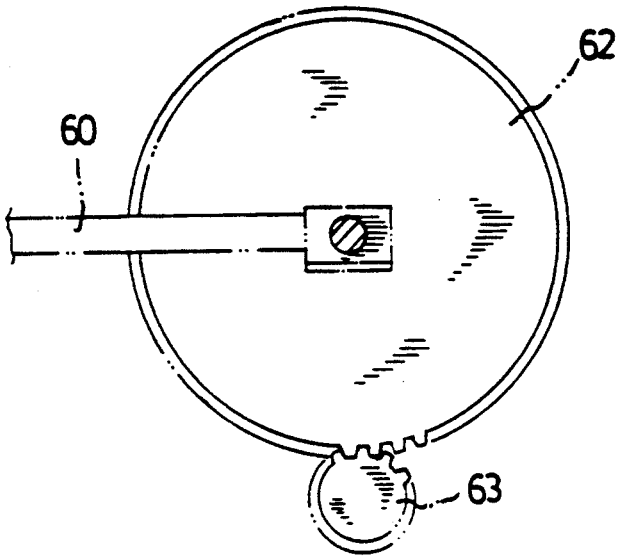
FIG. 12 is a schematic view illustrating the arm of FIG. 8 driven to control the traffic of the front side of the road when in red light condition.
Figure 13:
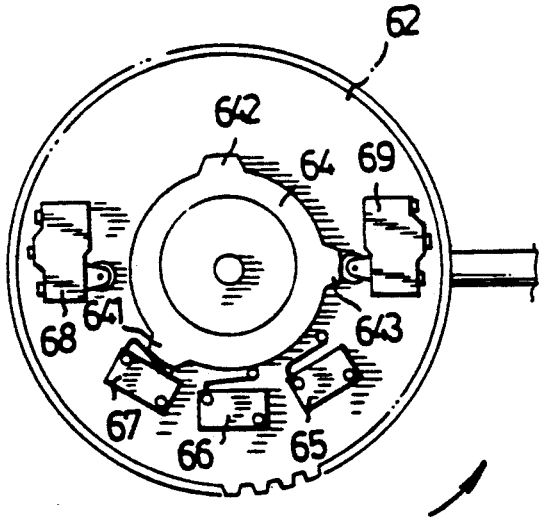
FIG. 13 is a schematic view illustrating the arm of FIG. 8 driven to control the traffic of the rear side of the road when in red light condition.

Referring to FIG. 8, a first gear wheel 62 is fixed inside the upper column 4. The first gear wheel 62 has a central shaft 620 therein connected to the arm 60. A second gear wheel 63 is installed under the first gear wheel 62 with the gear teeth of both wheels intermeshed with each other. The second gear wheel 63 is connected to a gear set (not shown) which is connected to a motor (not shown). The motor and the gear set are well known and not described in detail herein. FIG. 9 is the opposite side of FIG. 8. A cam 64 having a first lobe 641, a second lobe 642, and a third lobe 643 is firmly fixed at the opposite side of the first gear wheel 62. The spatial relation between the three lobes are designed such that the angle of circumference between the first lobe 641 and the second lobe 642 is 135°, the angle of circumference between the second lobe 642 and the third lobe 643 is 90°, and the angle of circumference between the third lobe 643 and the first lobe 641 is 135°. A second micro-switch 65 is firmly fixed in an appropriate position in the upper column 4. A third micro-switch 66, a fourth micro-switch 67, a fifth micro-switch 68, and a sixth micro-switch 69 are also firmly fixed in the upper column 4, where the fifth micro-switch 68 and the sixth micro-switch 69 are positioned at two ends of the horizontal extension diameter of the central shaft 620 of the cam 64, the third micro-switch 66 is positioned in the lqwer end of the vertical extension diameter of the cam 64, and the second micro-switch 65 and the fourth micro-switch 67 are respectively positioned beside the third micro-switch 66. An angle of circumference substantially equal to 90° is formed between the second micro-switch 65 and the fourth micro-switch 67 with respect to the central shaft 620 of the first gear wheel 62. The second micro-switch 65, the third micro-switch 66, and the fourth micro-switch 67 each respectively controls the on/off of the green light, the yellow light, and the red light. When the first lobe 641 contacts the second micro-switch 65, the green light will be turned on and remain in the "on" status, until the first lobe 641 discontacts the second micro-switch 65. When the first lobe 641 contacts the third micro-switch 66, the yellow light will be turned on and remains in the "on" status, until the first lobe 641 discontacts the third micro-switch 66. When the first lobe 641 contacts the fourth micro-switch 67, the red light will be turned on and remains in the "on" status, until the first lobe 641 discontacts the fourth micro-switch 67. When the arm 60 is in a vertical position, the first lobe 641 just contacts with the second micro-switch 65 and the second lobe 642 contacts with the fifth micro-switch 68, as shown in FIGS. 8 and 9. When the arm 60 is in 45° posi tion, the first lobe 641 just contacts with the third micro-switch 66, as shown in FIGS. 10 and 11. When the arm 60 is in a horizontal position, the first lobe 641 just contacts with the fourth micro-switch 67 and the third lobe 643 contacts with the sixth micro-switch 69, as shown in FIGS. 12 and 13. The fifth micro-switch 68 is a forward rotation switch which will trigger the motor to rotate in clockwise direction when contacted by the second lobe 642. The sixth micro-switch 69 is a reverse rotation switch which will trigger the motor to rotate in clockwise direction when contacted by the third lobe 643. The micro-switches 65, 66, and 67 are well spaced such that at any time only one of the micro-switches contacts with the first lobe 641. The fifth micro-switch 68 and the sixth micro-switch 69 can limit the second lobe 642 and the third lobe 643 to reciprocate in the half circular range, no matter the power is "on" or "off", i.e., even when the power is off, a person can not manually rotate the arm 60 out of the vertical-to-horizontal (90°) range.

To start operation, the traffic officer manually adjusts the arm 60 in the vertical position as shown in FIG. 8, and turns on the power, then the green light is "on" and the motor rotates in clockwise direction, causing the first lobe 641 to rotate in a clockwise direction as shown in FIG. 9. The motor keeps rotating in clockwise direction, causing the arm 60 to move to the 45° position as shown in FIG. 10, and in the opposite side of the first wheel 62, causing the first lobe 641 to contact with the third micro-switch 66 as shown in FIG. 11, thus the green light is "off" and the yellow light is "on". The motor keeps rotating in clockwise direction, causing the arm 60 to move to the horizontal position as shown in FIG. 12, and in the opposite side of the first wheel 62, causing the first lobe 641 to contact with the fourth micro-switch 67 and after a relative short time causing the third lobe 643 to contact with the sixth micro-switch 69 as shown in FIG. 13, thus the yellow light is "off", the red light is "on", and the motor starts to rotate in counter-clockwise direction. When the motor rotates in counter-clockwise direction, the function of the lights and the micro-switches is in a reversed sequence to that mentioned in the clockwise rotation and is thus not described in detail herein. The motor will keep rotating in clockwise direction and counter-clockwise direction alternately, thus causing the arm 60 to reciprocate between the vertical position (see FIG. 8) and the horizontal position (see FIG. 12). The timing distribution of the green light, the yellow light, and the red light can be adjusted by adjusting the arcuate distance between the micro-switches 65, 66, and 67.

Figure 14:
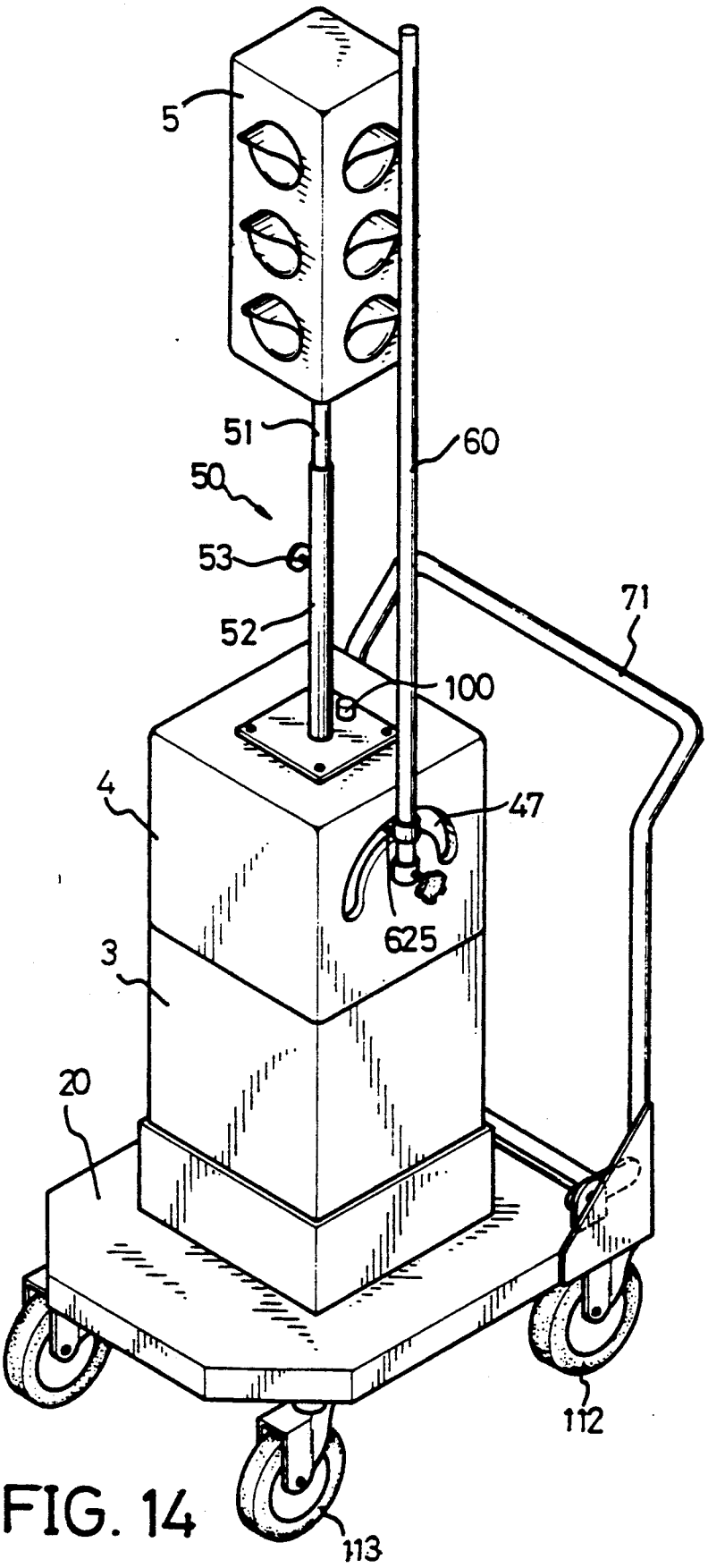
FIG. 14 is another embodiment of the present invention illustrating the height of the traffic lights is adjustable.
Figure 15:
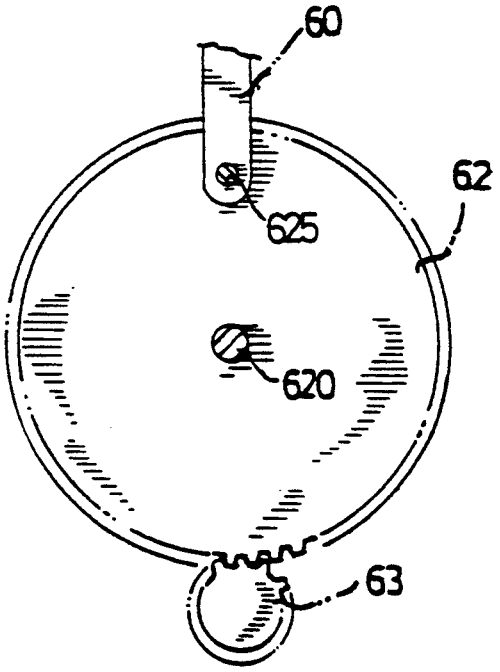
FIG. 15 illustrates the first gear wheel of FIG. 8 further having an eccentric rod connected to the arm.

Referring FIG. 14, another embodiment of the traffic control cart is shown. In this embodiment the pivotal structure between the upper column 4 and the lower column 3 is the same as the previous one, the wheel assembly is the same as the previous embodiment, the reciprocating structure and theory of the arm 60 is substantially same as the previous one except for a minor difference as will be described later. In this embodiment, the light means 5 contains some changes from the previous embodiment. There are lights in three of the faces of the light means, i.e., each side contains green, yellow, and red lights. Car drivers still can see the light even when the arm 60 of the cart is hit by a car. A telescopical means 50 includes an outer tube 52, an inner tube 51 telescopically positioned in the outer tube 52, and a bolt member 53 for firmly securing the inner tube 51 inside the outer tube 52. The bolt member 53 allows the telescopical release or securement of the inner tube to the outer tube 52. A semicircular slot 47 is formed in one face of the upper column 4. Also referring to FIG. 15, the first gear wheel 62 has an eccentric rod 625 thereon for connecting to the arm 60. Therefore the arm 60 is controlled by the eccentric rod 625. The first gear wheel 62 also has the central shaft 620 as its rotation center. When the first gear wheel 62 rotates, the eccentric rod 625 is transmitted to reciprocate in the semicircular slot 47. Actually the reciprocating range of the eccentric rod 625 is within the left half of the semicircular slot 47. The greatest change of the embodiment from the previous one is the braking means as will be described below.

Figure 16:
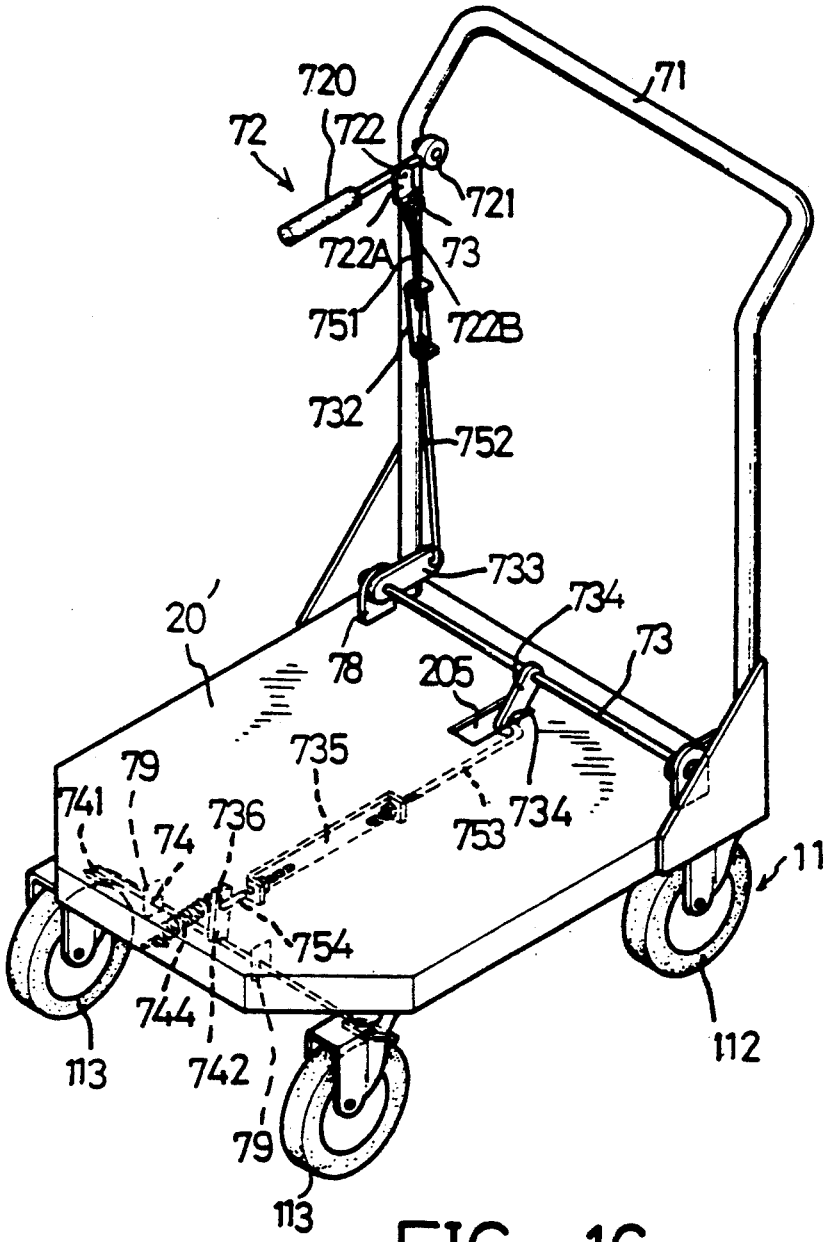
FIG. 16 illustrates another embodiment illustrating another structure of the braking means of the present invention.

Referring to FIG. 16, a handle frame 71 is firmly fixed on the rectangular base 20' (which is substantially same shaped as the base 20 in the previous embodiment) provided for the traffic officer to move easily. The braking means actually is a front wheel brake. The braking means comprises a pair of first mounting brackets 78 respectively fixed on two top surface corners of the rear side of the base 20', a pair of second mounting brackets 79 respectively fixed on two bottom surface corners of the front side of the base 20', a pivotal lever 72, a first engaging plate 731, a first transmission rod 751, a second engaging plate 732, a second transmission rod 752, a third engaging plate 733, a first rotation rod 73, a fourth engaging plate 734, a third transmission rod 753, a fifth engaging plate 735, a fourth transmission rod 754, a sixth engaging plate 736, a second rotation rod 74, and two braking members 741. The pivotal lever 72 includes a handle 720 and a pivotal socket 721 which is connected to a vertical side of the frame 71. The first engaging plate 722 is "L" shaped having a vertical portion (722A) connected to the handle 720 of the pivotal lever 72 and a horizontal portion 722B. The first transmission rod 751 has one end connected to the horizontal portion 722B of the first engaging plate 731 and a second end connected to a first end of the second engaging plate 732. The second transmission rod 752 is a hook structure which has a first end connected to a second end of the second engaging plate 732. The second transmission rod 752 has a second end which is substantially a pivot-hook structure connected to a first end of the third engaging plate 733. The third engaging plate 733 has a second end connected to one end of the first rotation rod 73 which is further pivotally connected to and supported by the pair of first mounting brackets 78 in two distal ends thereof. The fourth engaging plate 734 has a first end connected to substantially a middle portion of the first rotation rod 73 and a second end connected to a first end of the third transmission rod 753. A slot 205 is formed in the base 20' substantially under the middle portion of the first rotation rod 73 allowing substantially a half portion of the fourth engaging plate 734 to reciprocate freely therethrough. The third transmission rod 753 has a second end connected to a first end of the fifth engaging plate 735. The fifth engaging plate 735 has a second end connected to a first end of the fourth transmission rod 754. The fourth transmission rod 754 is "L" shaped having a longitudinal portion and a lateral portion. The longitudinal portion of the fourth transmission rod 754 has the first end connected to fifth engaging plate 735 and the lateral portion thereof has a second end penetrating a first end of the sixth engaging plate 736 and further connected to a first end of the spring 744. The spring 744 has a second end firmly fixed on an inner wall of the base 20'. The sixth engaging plate 736 has a second end firmly secured to substantially a middle portion of the second rotation rod 74. The second rotation rod 74 is pivotally connected to and supported by the second mounting brackets 79. The braking members 741 are connected to two distal ends of the second rotation rod 74. Similar to the previous embodiment, the cart is allowed to remain in a braking status or a non-braking status FIG. 16 illustrates a non-braking status of the cart, where the handle 720 is in a lateral position, the braking members 741 do not contact against the front rolling wheels 113. When the user want to change the cart from braking status to non-braking status, he lifts the handle 720 to a substantially vertical position, thus lifting the first engaging plate 731, the first transmission rod 751, the second engaging plate 732, the second transmission rod 752, thus clockwisely rotating the third engaging plate 733, the first rotation rod 73, and the fourth engaging plate 734 in substantially 90 degrees, which in turns pull the third transmission rod 753, the fifth engaging plate 735, the fourth transmission rod 754, the sixth engaging plate 736, and the spring 744 to a substantially rear and down direction. In the mean time, the sixth engaging plate 736 pulls the second rotation rod 74 to clockwisely rotate in an appropriate degree thus causing the braking members 741 to contact against the front rolling wheels 113 and brake the cart.

Figure 17:
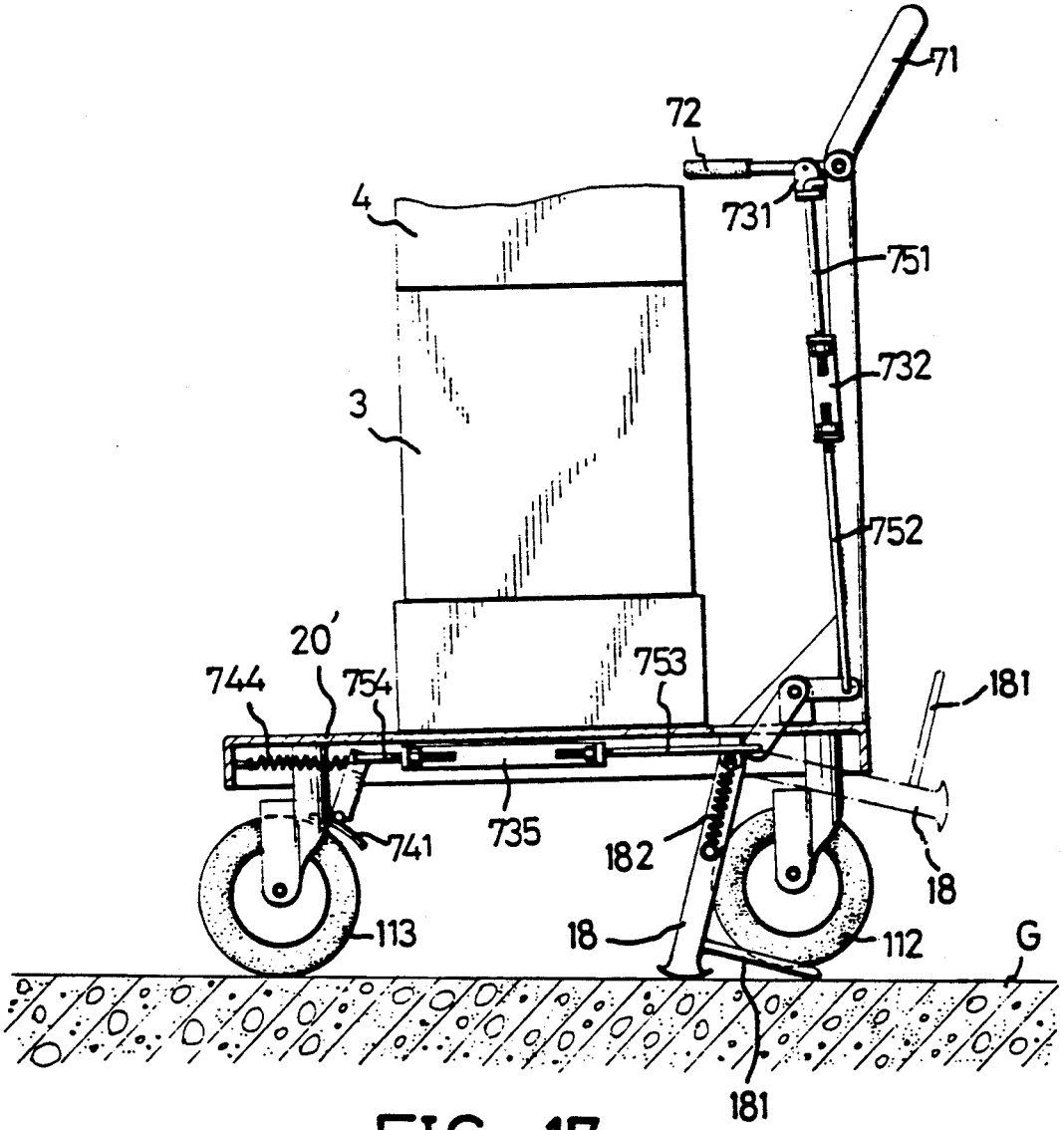
FIG. 17 illustrates the cart of FIG. 16 is in a braking status.

Referring to FIG. 17, a stand 18 having a spring 182 and a step 181 is pivotally fixed in the rear portion of the base 20' for the user to position the cart in a proper place. Since the stand 18 is well known, it is not described in detail herein.

Actually the light means 5 is allowed to be installed in a first cart (not shown) and the arm 60 together with the columns 4 and 3 are installed in a second cart (not shown) with a few requisite additional wires (not shown) connected therebetween, thus separating the light means 5 and the arm 60 yet controlling both in a synchronous way similar to the previous embodiment.

Although the invention has been explained in relation to its preferred embodiment, it is to be understood that many other possible modifications and variations can be made without departing the spirit and scope of the invention as hereinafter claimed.

I claim:

1. A traffic control cart comprising a light means (5) having at least a green, a yellow, and a red light formed thereon;

a wheel assembly (11) including a pair of front rolling wheels (113) and a pair of rear rolling wheels (112);

a casing-like base (20) having periphery walls extending downward being securely mounted on said wheel assembly (11);

a column (3 and 4) having casing structure therein being firmly fixed on said base (20);

a gear wheel means (62) transmitted by a motor-gear set being installed in said column (3 and 4) having a central shaft (620) extending from a center thereof penetrating through a periphery face of said column (3 and 4) and having one end protruding out of said column (3 and 4);

a plurality of micro-switches being firmly fixed inside said column (3 and 4) for responding to the reciprocating of said gear wheel means (62) and actuating one of said lights; and an arm (60) connected to said protruding end of said central shaft (620) being transmitted by said central shaft (620) and reciprocating in a ninety-degree range.

2. The traffic control cart as claimed in claim 1, wherein said gear wheel means (62) comprises a cam (64) concentric with said central shaft (620) having a first lobe (641), a second lobe (642), and a third lobe (643) spaced in a first degree between said first lobe (241) and said second lobe (642), a second degree between said second lobe (642) and said third lobe (643), a third degree between said third lobe (643) and said first lobe (641).

3. The traffic control cart as claimed in claim 2, wherein said plurality of micro-switches comprises a green light switch (65) for triggering said green light when contacted by said first lobe (641), a yellow light switch (66) allowed to actuate said yellow light when contacted by said first lobe (641), a red light switch (67) allowed to actuate said red light when contacted by said first lobe (641), a forward switch (68) responding to the contact of the second lobe (642) and forcing said motor to rotate clockwisely, and a reverse switch (69) responding to the contact of said third lobe (643) and forcing said motor to rotate counter-clockwisely, said forward switch (68) and said reverse switch (69) being symmetrically and firmly positioned at two distal ends of a horizontal diameter extension of said cam (64) suitable to contact said second lobe (642) and said third lobe (643) when said cam (64) rotates, said green light switch (65), said yellow light switch (66), and said red light switch (67) being firmly fixed around the lower half circle of said cam (64) suitable to contact said first lobe (641) when said cam (64) rotates, thus limiting said arm (60) to reciprocate within a predetermined angle range.

4. The traffic control cart as claimed in claim 3, wherein said column means (3 and 4) comprises a lower column (3) firmly fixed on said base (20) and an upper column (4) pivotally engaging to said lower column (3);

said lower column (3) including a lower pivotal means (30) at the top thereof;

said upper column (4) including an upper pivotal means (40) at the bottom thereof being pivotally engaged to said lower column (3);

a bearing assembly including a bearing (35), a bolt (36), and a nut (37) for pivotally securing said upper pivotal means (40) to said lower pivotal means (30).

5. The traffic control cart as claimed in claim 4, wherein said upper pivotal means (40) comprises a first plate (41), and said lower pivotal means (30) comprises a second plate (31) which has similar dimensions and shape as said first plate (41);

said first plate (41) comprising a first central hole (410), four flange portions (411) at four sides bent upward therefrom for securing an upper casing body of the upper column;

said second plate (31) comprising a second central hole (310) substantially corresponding to said first central hole (410) of said first plate (41), said first central hole (410) and said second central hole (310) being in alignment with each other, four flange portions (311) at four sides bent downward therefrom for securing to a lower casing body of the lower column;

said bearing member (35) being interconnected between said first plate (41) and said second plate (31) by securing said bolt (36) at a lower surface of said second plate (31) through said central holes (310, 410) to said nut (37) positioned at an upper periphery of said first central hole (410) of said first plate (41).

6. The traffic control cart as claimed in claim 5, wherein said upper pivotal means (40) further comprises four positioning means (42), said first plate (41) further comprises four first corner holes (412) symmetrically distributed around said first central hole (410), said second plate (31) further comprises four second corner holes (312) symmetrically distributed around said second central hole (310), each corresponding to one of said first corner holes (412), each corresponding first corner hole (412) and second corner hole (312) being in alignment with each other;

each said positioning means (42) being firmly fixed at the top surface of said first plate (41), while a depressible end thereof is placed against a corresponding said second corner hole (312) thereby positioning said upper pivotal means (40) on said lower pivotal means (30).

7. A traffic control cart comprising a light means (5) having at least a green, a yellow, and a red light formed thereon;

a wheel assembly (11) including a pair of front rolling wheels (113) and a pair of rear rolling wheels (112);

a casing-like base (20) having periphery walls extending downward being securely mounted on said wheel assembly (11);

a column (3 and 4) having casing structure therein being firmly fixed on said base (20);

a gear wheel means (62) transmitted by a motor-gear set being installed in said column (3 and 4) having an eccentric shaft (625) extending therefrom penetrating through a periphery face of said column (3 and 4) and having one end protruding out of said column (3 and 4);

a plurality of micro-switches being firmly fixed inside said column (3 and 4) for responding to the reciprocating of said gear wheel means (62) and actuating one of said lights; and an arm (60) connected to said protruding end of said eccentric shaft (625) being transmitted by said eccentric shaft (620) and reciprocating within a ninety-degree range.

* * * * *